US006210200B1

(12) United States Patent
Kranzdorf

(10) Patent No.: US 6,210,200 B1
(45) Date of Patent: Apr. 3, 2001

(54) MODULAR CONNECTOR FOR A TELECOMMUNICATIONS CABLE WITH ANTI-SNAG FEATURE

(76) Inventor: Michael Kranzdorf, 505 Hughes Rd., King of Prussia, PA (US) 19406

( * ) Notice: Subject to any disclaimer, the term of this patent is extended or adjusted under 35 U.S.C. 154(b) by 0 days.

(21) Appl. No.: 09/330,564

(22) Filed: Jun. 11, 1999

(51) Int. Cl.[7] ..... H01R 4/50; H01R 13/625
(52) U.S. Cl. ..... 439/344; 439/354
(58) Field of Search ..... 439/344, 447, 439/354

(56) References Cited

U.S. PATENT DOCUMENTS

| | | | | |
|---|---|---|---|---|
| 4,615,575 | * | 10/1986 | Kossor | 439/304 |
| 5,462,457 | | 10/1995 | Schroepfer et al. | 439/736 |
| 5,494,457 | | 2/1996 | Kunz | 439/447 |
| 5,538,438 | | 7/1996 | Orlando | 439/344 |
| 5,562,475 | * | 10/1996 | Kern, Jr. et al. | 439/344 |
| 5,613,869 | | 3/1997 | Erlich et al. | 439/344 |
| 5,685,731 | * | 11/1997 | Lin | 439/344 |
| 5,685,736 | | 11/1997 | Lung | 439/447 |
| 5,975,936 | * | 11/1999 | Lin et al. | 439/344 |

* cited by examiner

*Primary Examiner*—Khiem Nguyen
*Assistant Examiner*—Hae Moon Hyeon
(74) *Attorney, Agent, or Firm*—LaMorte & Associates P.C.

(57) ABSTRACT

A connector device for use in terminating a telecommunications cable. The connector device includes a main connector body having a top surface, a bottom surface and a rear surface extending between said top surface and said bottom surface. The connector device also includes a locking pawl that extends from the top surface of the main connector body. The locking pawl extends a predetermined maximum distance from the top surface of the main connector body. A guard element extends over at least part of the rear surface of the main connector body. The guard element extends above the top surface of the main connector body to a height at least as high as the maximum height of the locking pawl. The guard element can be supported by the locking pawl, the main connector body or both.

16 Claims, 4 Drawing Sheets

MODULAR CONNECTOR FOR A TELECOMMUNICATIONS CABLE WITH ANTI-SNAG FEATURE

BACKGROUND OF THE INVENTION

1. Field of the Invention

The present invention relates to the modular connectors used to terminate telecommunication cables. More particularly, the present invention relates to modular connectors for telecommunication cables that contain a feature that prevents the locking pawl on the modular connector from snagging on other objects.

2. Description of the Prior Art

Many businesses have dedicated telecommunication systems that enable computers, telephones, facsimile machines and the like to communicate with each other, through a private network, and with remote locations via a telecommunications service provider. In most buildings, the dedicated telecommunications system is hard wired using telecommunication cables that contain conductive wire. In such hard wired systems, dedicated wires are coupled to individual service ports throughout the building. The service ports are designed to receive modular connectors from telephones, computers, facsimile machines and the like. The wires from the dedicated service ports extend through the walls of the building to a telecommunications closet or closets. The telecommunications lines from the interface hub of any main frame computer and the telecommunication lines from external telecommunication service providers are also terminated within the telecommunications closets.

A patching system is used to interconnect the various telecommunication lines within the telecommunications closet. In a telecommunications patching system, all of the telecommunication lines are terminated at connector ports within the telecommunications closet. Accordingly, the various telecommunication lines are arranged in an organized manner.

Within the telecommunications closet, patch cords are used to interconnect the various connector ports within the telecommunications closet. Patch cords are telecommunication cables that are terminated at both ends with a modular connector. The most commonly used modular connectors are the RJ-11 connector and the RJ-45 connector. Both connectors contain a locking pawl that extends from the main body of the connector. The locking pawl is used to mechanically connect and disconnect the modular connector to a connector port.

In a telecommunication closet, there may be thousands of patch cords. Each of the patch cords is routed in a different manner throughout the telecommunications closet. Accordingly, each patch cord may be intertwined with hundreds of other patch cords.

Often a technician must remove or reroute a patch cord within a telecommunications closet. Accordingly, a technician must separate a specific patch cord from the others. When a modular connector on a patch cord is removed from a connector port, the locking pawl that extends from the modular connector acts as a hooked barb. The locking pawl has a tendency to snag on any object across which the modular connector may pass. Accordingly, it is nearly impossible to pull a modular connector through other cables without the modular connector becoming snagged. If a technician continues to pull on a patch cord after it becomes snagged, the locking pawl can easily become damaged. Once the locking pawl is damaged, the modular connector is rendered useless and a new modular connector must be added to the end of the patch cord.

In the prior art, technicians often tape the locking pawl of modular connectors down before they pull the modular connector through an obstructed path. However, the use of tape is tedious and both labor and time intensive. To simplify matters, other approaches have been explored in the prior art. One such approach has been the use of an elastomeric boot over the modular connector. In such prior art approaches, an elastomeric boot is wrapped around the modular connector so that the boot covers the extending pawl. The boot prevents objects from snagging on the locking pawl and still enables the locking pawl to function in its designed manner. A problem with protective boots is that they are relatively expensive and difficult to install. Accordingly, when terminating a telecommunication cable, a technician must both install the modular connector and then install the protective boot. In systems that have many thousands of modular connectors, the use of protective boots quickly becomes cost, labor and time prohibitive.

Recognizing the problems associated with protective boots, modular connectors have been designed with integral snag-free features. In such prior art modular connectors, the main body of the modular connector is typically designed to protrude farther than does the locking pawl. In this manner, the body of the connector itself prevents the locking pawl from becoming snagged. Such prior art modular connectors are exemplified by U.S. Pat. No. 5,613,869 to Erlich, entitled, Modular Connector For A Communication Line.

A problem associated with such snag-free modular connectors is the fact that the enlarged body of the connector restricts access to the pawl. Accordingly, it is now more difficult for a technician to engage the pawl and disconnect the modular connector from a connector port. The problem is most prevalent in crowded telecommunications closets where a technician has very little room to manipulate his/her fingers when connecting or disconnecting a specific modular connector.

A need therefore exists in the art for a modular connector with an integral snag-free design that is low cost and does not restrict access to the locking pawl. This need is met by the present invention as described and claimed below.

SUMMARY OF THE INVENTION

The present invention is a connector device for use in terminating a telecommunications cable. The connector device includes a main connector body having a top surface, a bottom surface and a rear surface extending between said top surface and said bottom surface. The main connector body is adapted to receive the telecommunication cable through the rear surface.

The connector device also includes a locking pawl that extends from the top surface of the main connector body. The locking pawl is used to lock the connector device in place in a connector port. The locking pawl extends a predetermined maximum distance from the top surface of the main connector body. A guard element extends over at least part of the rear surface of the main connector body. The guard element extends above the top surface of the main connector body to a height at least as high as the maximum height of the locking pawl. The guard element can be supported by the locking pawl, the main connector body or both.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used to terminate many different types of conductive wire cables, the present invention is especially well suited for terminating telecommunication cables containing between four and eight wires. Such telecommunication wires are most commonly used for voice and data communications. Consequently, by way of example, the present invention device will be described in an application where it is used to terminate a telecommunications cable.

Figure 1:
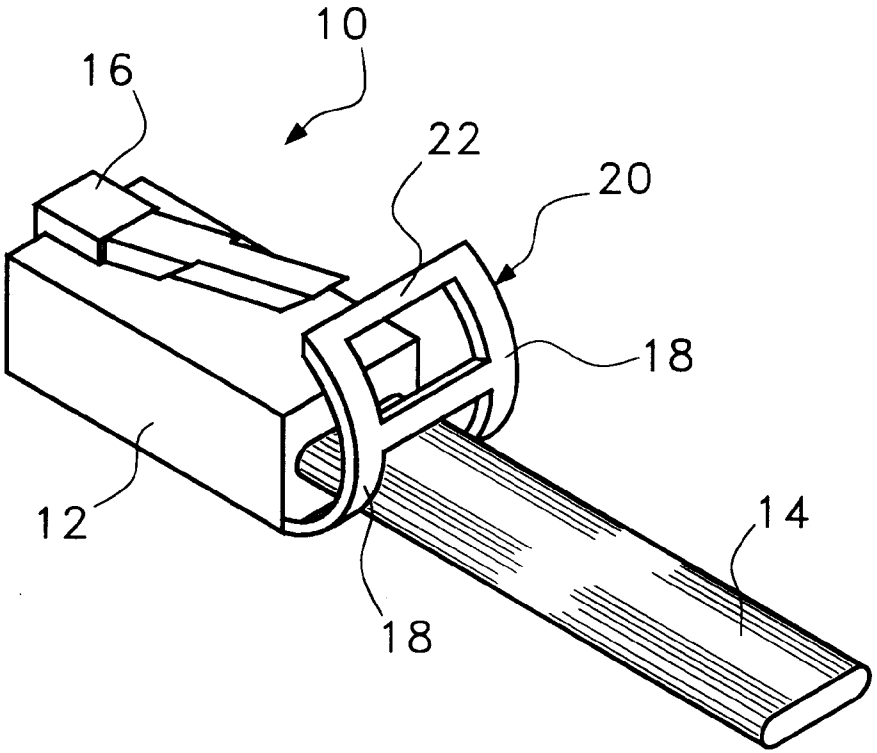
FIG. 1 is a perspective view of an exemplary embodiment of a modular connector in accordance with the present invention.

Referring to FIG. 1, a first exemplary embodiment of a modular connector 10 is shown. The modular connector 10 has a main body 12 that is shaped the same as prior art modular connectors. The main body 12 of the modular connector 10 connects to the end of a telecommunications cable 14 in a traditional manner. The modular connector 10 also has a locking pawl 16 that extends from the main body 12 of the modular connector 10. The locking pawl 16 has the same shape as prior art locking pawls and operates in the same manner as prior art locking pawls.

What distinguishes the shown modular connector 10 from prior art modular connectors is the presence of a flexible guard 20. In the shown embodiment, the flexible guard 20 has two parallel arm elements 18 that extend from the bottom rear of the main body 12 of the modular connector 10. The arm elements 18 are curved and hook upwardly and around the top of the main body 12 of the modular connector 10 to a point at least as high as that of the locking pawl 16. The arm elements 18 pass along both sides of the telecommunications cable 14 and therefore do not interfere with the movement of the telecommunications cable 14 or the ease at which the modular connector 10 is attached to the telecommunications cable 14.

The arm elements 18 of the flexible guard 20 are interconnected by at least one cross element 22. At least one cross element 22 is supported by the arm elements 18 in front of the locking pawl 16. In this manner, the cross element 22 prevents an object from passing between the arm elements 18 and engaging the locking pawl 16.

The flexible guard 20 is a structure that is capable of being elastically deformed numerous times without damage. Accordingly, when a technician depresses the locking pawl 16 and the guard element 20 simultaneously, the guard element 20 will move downwardly with the locking pawl 16. When pressure is removed from the locking pawl 16, the locking pawl 16 returns to its original position. Similarly, the curved structure of the arm elements 18 in the flexible guard 20 creates a spring bias in the flexible guard 20 that also returns it to its original position when any externally applied manipulation force is removed.

The flexible guard 20 can be manufactured as a separate structure and then bonded to the main body 12 of the modular connector 10. However, in the preferred embodiment, the flexible guard 20 is preferably integrally molded as part of the main body 12 of the modular connector 10. As such, the flexible guard 20 and the main body 12 are unistructurally formed from a common material.

As the telecommunications cable 14 is pulled, the flexible guard 20 acts as a plow and prevents any object from directly engaging the locking pawl 16. As such, the modular connector 10 can be pulled through obstructed areas with a much lower chance of the locking pawl 16 becoming snagged or damaged.

Figure 2:
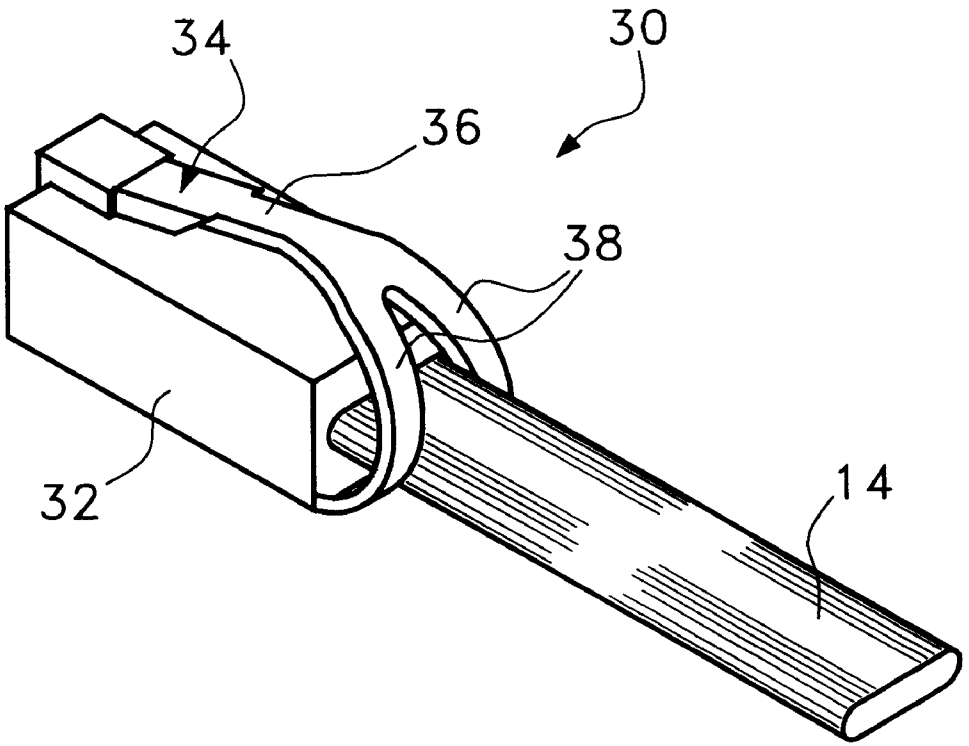
FIG. 2 is a perspective view of a second exemplary embodiment of a modular connector in accordance with the present invention.

Referring to FIG. 2, a second embodiment of a modular connector 30 is shown. In this embodiment, the main body 32 of the modular connector 30 is the same as is available in the prior art. As such, the main body 32 of the modular connector 30 attaches to a telecommunications cable 14 in the traditional manner. In the shown embodiment, it is the structure of the locking pawl 34 that incorporates a snag-free feature.

The locking pawl 34 is connected to the main body 32 of the modular connector 30 in a traditional manner. However, the locking pawl 34 is Y-shaped. The stem 36 of the locking pawl 34 extends away from the main body of the modular connector 30 in a standard direction and pitch. However, instead of terminating a predetermined distance above the main body 32 of the modular connector 30, the locking pawl 34 splits into two diverging arm elements 38. The arm elements 38 curve downwardly around the rearward edge of the modular connector's main body. The arm elements 38 diverge apart enough to pass along the sides of the telecommunications cable 14, wherein the arm elements 38 terminate at a point either at or below the level of the telecommunications cable 14.

As the arm elements 38 of the locking pawl 34 descend around the rear of the main body 32 of the modular connector 30, the arm elements 38 follow a curved path. Accordingly, as the telecommunications cable 14 is pulled, the curved arm elements 38 of the locking pawl 34 acts as a plow and prevent any object from directly snagging the locking pawl 34. As such, the modular connector 30 can be pulled through obstructed areas with a much lower chance of the locking pawl 34 becoming snagged or damaged.

The locking pawl 34 is still interconnected to the main body 32 of the modular connector 30 in a traditional manner. Accordingly, the locking pawl 34 can still be manually manipulated in the manner of a traditional locking pawl. As such, the embodiment of the locking pawl 34 described still performs the same interlocking function in the same manner as prior art locking pawls.

Figure 3:
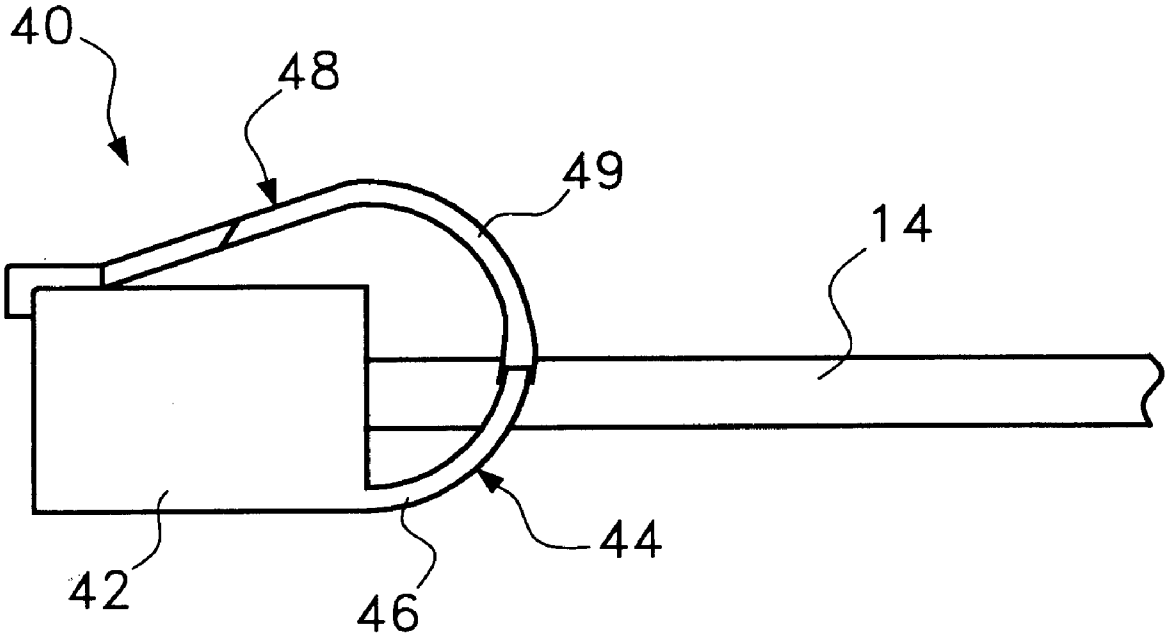
FIG. 3 is a side view of a third exemplary embodiment of a modular connector in accordance with the present invention.

Referring to FIG. 3, an embodiment of the present invention modular connector 40 is shown that is, in many ways, a combination of the embodiments of FIG. 1 and FIG. 2. In the embodiment of FIG. 3, a flexible guard 44 extends from the rear bottom of the main body 42 of the modular connector 40. The flexible guard 44 is comprised of two arm elements 46 that curve upwardly toward the top of the modular connector's main body 42. The arm elements 46 terminate approximately half way up the modular connector 40 in the area of the telecommunications cable 14.

The locking pawl 48 is Y-shaped. The stem of the locking pawl 48 extends away from the main body 42 of the modular connector 40 in a standard direction and pitch. However, instead of terminating a predetermined distance above the main body 42 of the modular connector 40, the locking pawl 48 splits into two diverging arm elements 49. The arm elements 49 curve downwardly around the rearward edge of the modular connector's main body 42. The arm elements 49 diverge apart enough to pass along the sides of the telecommunications cable 14, wherein the arm elements 49 terminate at a point below the level of the telecommunications cable 14 in an area that overlaps the flexible guard 44. The arm elements 49 of the locking pawl 48 pass either inside or outside the arm elements 46 of the flexible guard 44. As such, the arm elements 49 of the locking pawl 48 and the arm elements 46 of the flexible guard 44 do not interfere with one another.

As the arm elements 49 of the locking pawl 48 descend around the rear of the main body 42 of the modular connector, the arm elements 49 follow a curved path. Accordingly, as the telecommunications cable 14 is pulled, the curved arm elements 49 of the locking pawl 48 acts as a plow and prevent any object from directly snagging the locking pawl 48. As such, the modular connector 40 can be pulled through obstructed areas with a much lower chance of the locking pawl 48 becoming snagged or damaged.

The locking pawl 48 is still interconnected to the main body 42 of the modular connector 40 in a traditional manner. Accordingly, the locking pawl 48 can still be manually manipulated in the manner of a traditional locking pawl. As such, the embodiment of the locking pawl 48 described still performs the same interlocking function in the same manner as prior art locking pawls.

Figure 4:
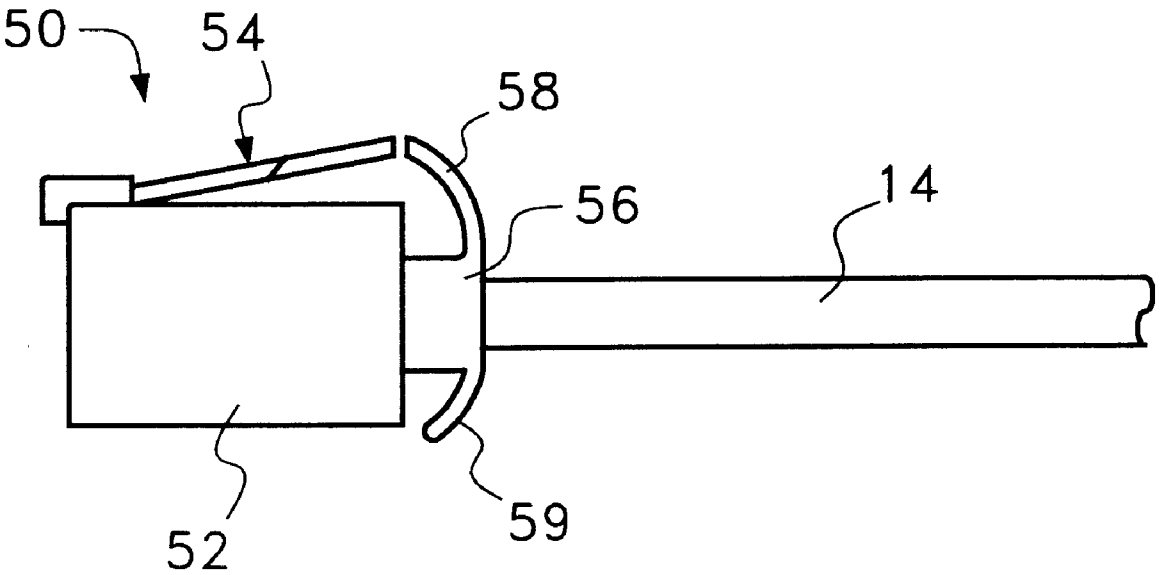
FIG. 4 is a side view of a fourth exemplary embodiment of a modular connector in accordance with the present invention.

Referring now to FIG. 4, another embodiment of the present invention modular connector 50 is shown. In this embodiment, the main body 52 of the modular connector 50 and the locking pawl 54 of the modular connector 50 are both the same as is available in the prior art. The modular connector 50 is unique in that a collar protrusion 56 extends rearwardly from the rear surface of the modular connector's main body 52. The collar protrusion 56 has a tubular configuration, wherein the telecommunications cable 14 passes through the collar protrusion 56.

Arm elements 58, 59 extend both upwardly and downwardly from the collar protrusion 56. The top arm elements 58 extend upwardly to a level at least as high as the highest part of the locking pawl 54. The lower arm elements 59 extend downwardly to a level at least as low as the bottom of the main body 52.

As the top arm elements 58 and the bottom arm elements 59 extend around the main body 52 of the modular connector 50, both sets of arm elements 58, 59 follow a curved path. Accordingly, as the telecommunications cable 14 is pulled, the curved arm elements 58, 59 act as a plow and prevent any object from directly snagging on either the locking pawl 54 or the main body 52 of the modular connector 50. As such, the modular connector 50 can be pulled through obstructed areas with a much lower chance of the locking pawl 54 or the main body 52 of the modular connector 50 becoming snagged or damaged.

In all of the exemplary embodiments illustrated, the arm elements, that curve in front of the main body of the modular connector to protect the locking pawl, can be either molded as part of the main body of the modular connector or attached to the main body of the modular connector. Accordingly, the material of the arm elements can be either the same as the main body or different. In either circumstance, the arm elements attach to the telecommunications cable as part of the modular connector, as the modular connector is attached to the telecommunications cable.

In all of the embodiments illustrated, the guard that prevents the locking pawl from becomimg snagged is comprised of flexible arms. It should be understood that such a configuration is merely exemplary. Structures other than arms can be used to protect the locking pawl. For example, bulbous obstructions can extend from the body of the modular connector instead of arms. The obstruction would prevent the locking pawl from becoming snagged in the same manner as would flexible arms.

It will be understood that a person skilled in the art could make alternate embodiments of the present invention using functionally equivalent embodiments that have not been specifically described. For example, the size and shape of the various arm elements can be altered as desired, provided they continue to protect the locking pawl from snagging. Similarly, the point of attachment between the various arm elements and the main body of the modular connector can also be changed into numerous configurations other than has been specifically shown. All such modifications and alternate embodiments are intended to be included in the scope of this disclosure as defined by the appended claims.

What is claimed is:

1. A connector device for terminating a telecommunications cable, comprising:

a main connector body having a top surface and a rear surface, wherein the main connector body receives the telecommunication cable through said rear surface;

a locking pawl extending from said top surface of said main connector body, wherein said locking pawl is moveable throughout a range of heights above said top surface;

at least one guard element extending from said main connector body, said at least one guard element being flexible and selectively moveable through said range of heights, wherein said at least one guard element extends across said rear surface of said main connector body and terminates above said main connector body at a height in said range of heights that is at least as high as said locking pawl.

2. The device according to claim 1, wherein said at least one guard element is curved between a first end and a second end, wherein said first end is coupled to said main connector body and said second end terminates above said main connector body.

3. The device according to claim 1, wherein said at least one guard element includes two parallel arm elements extending from said main connector body.

4. The device according to claim 3, wherein said arm elements are interconnected by at least one cross element.

5. The device according to claim 3, wherein said arm elements are spaced apart to enable the telecommunications cable to enter the rear surface of said main connector body in between said arm elements.

6. The device according to claim 4, wherein a cross element extends between said arm elements at a height in said range of heights that is at least as high as said locking pawl.

7. A connector device for terminating a telecommunications cable, comprising:

a main connector body having a top surface and a rear surface, wherein the main connector body receives the telecommunications cable through said rear surface; and a locking pawl having a first end and a second end, wherein said first end is coupled to said main connector body and said second end extends across said top surface and curves downwardly to a predetermined point over at least a section of said rear surface.

8. The device according to claim 7, wherein said locking pawl divides into two arm elements at a point in between said first end and said second end, whereby each of said arm elements terminates at said second end.

9. The device according to claim 8, wherein said arm elements are spaced apart to enable the telecommunications cable to enter the rear surface of said main connector body in between said arm elements.

10. The device according to claim 9, further including at least one guard arm extending from said main connector body, wherein said at least one guard arm extends across said rear surface of said main connector body and terminates at a point at least equal in position to said predetermined point.

11. The device according to claim 10, wherein said arm elements and said at least one guard arm overlap.

12. The device according to claim 10, wherein said arm elements are curved.

13. The device according to claim 12, wherein said at least one guard arm is curved.

14. A connector device for use in terminating a cable, comprising:

a main connector body having a top surface, a bottom surface and a rear surface extending between said top surface and said bottom surface, wherein the main connector body is adapted to receive the cable through said rear surface;

a locking pawl extending from said top surface of said main connector body, wherein said locking pawl extends a predetermined maximum distance from said top surface of said main connector body; and a guard element extending over at least part of said rear surface, from a point over said top surface at least as high as said predetermined distance, to said bottom surface of said main connector body;

wherein at least a segment of said guard element extends from said locking pawl.

15. The device according to claim 14, wherein at least a segment of said guard element extends from said main connector housing.

16. The device according to claim 14, wherein said guard element is generally semicircular in shape.

* * * * *